United States Patent [19]

Maeda

[11] Patent Number: 4,548,008

[45] Date of Patent: Oct. 22, 1985

[54] TILE PANEL HAVING CONVEX AND CONCAVE PORTIONS AROUND SUBSTRATE BOARD, AND METHOD FOR PRODUCTION THEREOF

[75] Inventor: Hisashi Maeda, Tokoname, Japan

[73] Assignee: Inax Corporation, Tokoname, Japan

[21] Appl. No.: 479,103

[22] Filed: Mar. 25, 1983

[51] Int. Cl.[4] ..... E04F 13/08

[52] U.S. Cl. ..... 52/392; 52/595; 52/594

[58] Field of Search ..... 52/315, 314, 385, 384, 52/392, 592, 591, 595, 594

[56] References Cited

U.S. PATENT DOCUMENTS

| | | | |
|---|---|---|---|
| 1,175,316 | 3/1916 | Solon | 52/591 |
| 1,828,193 | 10/1931 | Levin | 52/591 |
| 1,841,370 | 1/1932 | Grigsby | 52/395 |
| 2,027,292 | 1/1936 | Rockwell | 52/595 |
| 2,189,218 | 2/1940 | Neumeister | 52/591 |

FOREIGN PATENT DOCUMENTS

| | | | |
|---|---|---|---|
| 2300282 | 1/1973 | Fed. Rep. of Germany | 52/594 |
| 532020 | 1/1922 | France | 52/392 |
| 1230511 | 9/1960 | France | 52/392 |
| 116400 | of 1902 | United Kingdom | 52/591 |
| 254416 | 7/1926 | United Kingdom | 52/592 |
| 303324 | 1/1928 | United Kingdom | 52/392 |
| 473700 | 12/1937 | United Kingdom | 52/592 |

*Primary Examiner*—Henry E. Raduazo

*Attorney, Agent, or Firm*—Browdy and Neimark

[57] ABSTRACT

A novel prefabricated tile panel consisting of a rectangular or square substrate board having side-long rectangular convex and concave portions arranged regularly by turns around the sides of the rectangular or square shape and a multiplicity of tiles arranged regularly and bonded onto the substrate board is provided. The concave portion and convex portion are of specified dimensions, respectively. The convex portions are protruded and the concave portions are set back from the tiles arranged and bonded in a rectangular or square shape. Thus, the prefabricated tile panels can be assembled without trouble by inserting the convex portions of one panel in the concave portions of other panel or panels for installation of the tile panels. The prefabricated tile panel can be produced efficiently by using a frame which has matrices for tiles arranged at a tile-joint interval in a rectangular or square form and is equipped with guide members around the frame for accepting the substrate board in a predetermined position.

8 Claims, 6 Drawing Figures

TILE PANEL HAVING CONVEX AND CONCAVE PORTIONS AROUND SUBSTRATE BOARD, AND METHOD FOR PRODUCTION THEREOF

BACKGROUND OF THE INVENTION

This invention relates to a prefabricated tile panel and a method for production thereof. More particularly, the invention relates to a tile panel consisting essentially of a flat rectangular or square substrate board having side-long rectangular convex portions and concave portions of specified dimensions arranged by turns and a multiplicity of tiles arranged regularly and bonded onto the substrate board.

The advantages of ceramic tile walls and the like are well known especially for bathrooms, shower rooms, kitchens, etc. The setting of tiles at a construction site, however, requires a painstaking, time-consuming and skilled task. With the present high labor costs and the accelerated rate of construction, the conventional methods for installing tiles are extremely costly and time-consuming. The recent trend toward modular housing construction, wherein housing sections are factory built and joined together at the construction site, has further spotlighted the shortcomings of the traditional tile installation methods.

Thus, a variety of prefabricated tile panels including tiles bonded onto substrate boards or the like and having panel-securing means such as anchors have been proposed, for example, as disclosed in U.S. Pat. Nos. 3,646,180 and 3,817,012; the description being incorporated herein by reference to show the state of art and the foundation works for installing the prefabricated tile panels.

The prefabricated tile panels having convex and concave portions around the substrate boards thereof have been known in the art, for example, as disclosed in Japanese Utility Model Applications Nos. 37245/1971 and 37663/1972. The devices disclosed therein, however, seem to be impracticable paper plans, because they can hardly be installed effectively and efficiently. More specifically, the devices are different from the tile panel of the present invention in both the dimension and arrangement of the convex and concave portions. With reference to FIG. 5 attached which is shown in the above mentioned Application No. 37663/1972 and partly similar to the panel of the present invention, the vertical sides of the panel start with a convex or concave portion and end with a convex or concave portion or the shapes at the opposite corners of the panel differ from each other and, moreover, a side-long length of the convex portion is substantially the same as that of the concave portion. Thus, at least two types of the tile panels are needed to assemble and install the tile panels. This is troublesome at a construction site and especially so when such tile panels with patterns or designs are to be installed. Moreover, it is difficult or even impossible to insert the convex portions of a tile panel in the concave portions of other tile panel for installation of the tile panels, especially when some deviations or warpages took place upon the installation. In this connection, an approach to establishing small clearance between convex portions and concave portions is not successful because, when one tries to insert the convex portions of a tile panel in the concave portions of another panel, the convex portions of the neighboring side of the former panel overlap the convex portions of other adjacent tile panel as illustrated in FIG. 6. It has also been considered in the art that the clearance between the convex and concave portions of such a tile panel should be as small as possible to set assembled tile panels firmly. Incidentally, as far as the present inventor's knowledge is concerned, the prefabricated tile panels described above are not on the market.

Thus, the present inventor has made intensive researches on such prefabricated tile panels to accomplish the present invention and found that the above described problems or troubles can be solved or eliminated substantially by the prefabricated tile panel of the present invention. The inventor has also accomplished an effective method for producing the present prefabricated tile panel.

It is an object of the invention to provide a novel prefabricated tile panel to be installed readily and rapidly by those unskilled in the art.

It is another object of the invention to provide a novel method for producing the present prefabricated tile panel.

Other objects and advantages of the present invention will become apparent from the following description.

SUMMARY OF THE INVENTION

In accordance with the present invention, there is provided a prefabricated tile panel consisting essentially of a flat substrate board of a right-angled tetragon (i.e. rectangular or square) shape having substantially rectangular side-long convex portions and substantially rectangular side-long concave portions of the same plane by turns around the sides of the tetragonal shape, and a multiplicity of tiles arranged in a right-angled tetragon fashion and bonded onto the substrate board; said bonded tiles constituting a fundamental right-angled tetragon form; said rectangular convex portion being protruded by a given width of W from the fundamental tetragon form and having a side length of Lv; said rectangular concave portion being set back by a width of at least W from the fundamental tetragon form and having a side length of Lc; the relationship between the W, Lv and Lc being defined by the following expression, $$Lc \geqq Lv+2\times W, \text{ or } Lc=Lv+2\times W+C \ldots \quad \text{I}$$

wherein, Lv is larger than W, W is generally in the range of about 5 mm to about 15 mm, and normally about 9 mm and C is a clearance generally in the range of 0 to 10 mm; said rectangular concave and convex portions being arranged regularly by turns around the sides of the substrate board in the shape of the fundamental tetragon form in such a fashion that each side starts with one rectangular portion and ends with the other portion, more specifically, in such a fashion that a side of the substrate board starts with the concave (or convex) portion, is followed by other portions by turns repeatedly and then ends with the convex (or concave) portion, and the next side of the substrate board starts with the concave (or convex) portion and is repeated in the same way, and finally the fourth side of the substrate board ends with the convex (or concave) portion. Thus, the concave portions of a substrate board and the tiles bonded thereto constitute the spaces which are higher than the convex portions by the thickness of adhesive, where convex portions of other substrate boards can be inserted in and secured to. Incidentally, each of the convex portions can have at least one and preferably two small holes for nailing.

In accordance with the present invention, there is also provided a method for producing the above mentioned prefabricated tile panel which comprises the steps of placing a multiplicity of tiles with the top surfaces thereof down on a frame having matrixes for tiles arranged at a tile-joint interval in a right-angled tetragon form, each matrix preferably having an air vent or a hole for taking out the resulting tile panel easily, the frame having guide members around the frame for accepting a substrate board in a predetermined position;

applying an adhesive for tiles onto the top surface of the substrate board to a substantially uniform thickness; and placing the adhesive-coated substrate board with the coated surface down on the back surfaces of the tiles according to the guide members such as cross-pieces equipped around the upper sides of the frame, and applying to the substrate board (e.g., with a roller) a pressure for facilitating the adhesion; and, if desired, placing a supporting plate on the substrate board and upsetting the frame upside down to receive the prefabricated tile panel on the supporting plate. Incidentally, the fundamental right-angled tetragon form of the bonded tiles and the shape of the right-angled tetragonal substrate board having substantially rectangular side-long convex portions and concave portions by turns around the side of the fundamental tetragon form are as defined above.

DETAILED DESCRIPTION OF THE INVENTION

Preferred embodiments of the present invention are further explained in the following with reference to the attached drawings.

Figure 1:
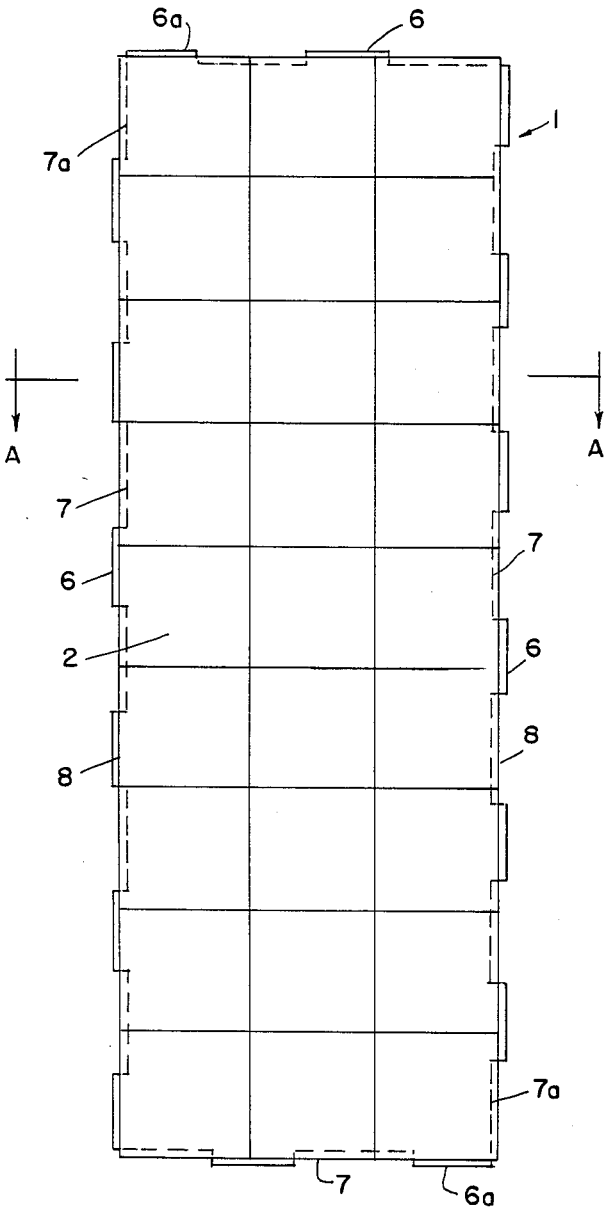
FIG. 1 is a schematic top view showing an embodiment of the prefabricated tile panels of the present invention.
Figure 5:
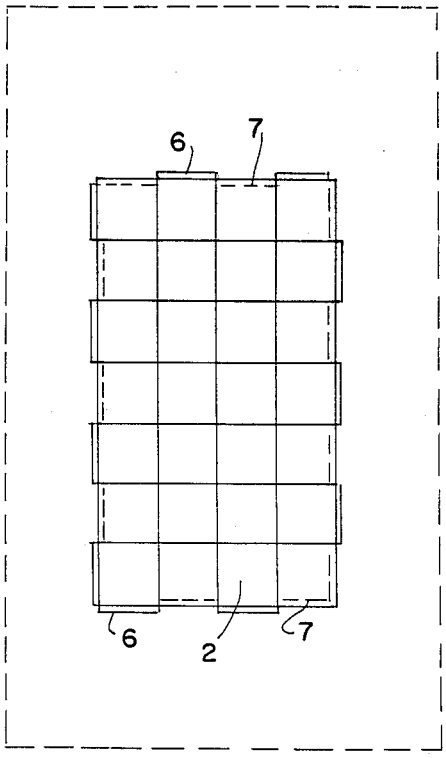
FIG. 5 is a schematic top view of a conventional prefabricated tile panel which is different from the present tile panel in both the dimension and arrangement of the convex and concave portions.

As described above, the substantially rectangular convex portions 6 and substantially rectangular concave portions 7 are arranged regularly by turns around the sides of the substrate board having the fundamental right-angled tetragon form 8 of bonded tiles. One pair of sides of form 8 may be longer than the other pair of sides of form 8, as is shown in FIG. 1. As is also shown in FIG. 1, the positions of the convex portions 6 and concave portions 7 on one side of the tetragonal form 8 fall line-symmetrically under those of the concave portions and convex portions on the opposite side of the tetragonal form 8, respectively. In other words, when a position on one side of the tetragonal form 8 is a convex portion 6 (or concave portion 7), the opposite position on the other side of the tetragonal form comes under a concave portion 7 (or convex portion 6). Moreover, the shape of a corner of the present panel is substantially point-symmetrical with that of a diagonally opposite corner about the center of the diagonal. Therefore, the panel is rotationally symmetric when rotated 180° about its center within the plane of the board. Thus, the present prefabricated tile panels of the same type can be assembled without trouble for installation of the tile panels, whereas conventional tile panels of similar structures do not have the concave and convex portion arranged regularly by turns around the sides of the fundamental tetragon form (e.g., as shown in FIG. 5, one of the vertical sides of the conventional panel starts with a convex portion and ends with a convex portion and the other vertical side starts and ends with concave portions) and thus combination of the panels of two different structures is sometimes needed for installation of the tile panels.

Moreover, with reference to the above mentioned expression I $$Lc = Lv + 2 \times W + C$$

(wherein C is generally 0 to 10 mm), it has been unexpectedly found that the difference in side lengths between the concave portion and the convex portion is required to be at least $2 \times W$ (i.e. $Lc - Lv \geqq 2 \times W$).

Figure 6:
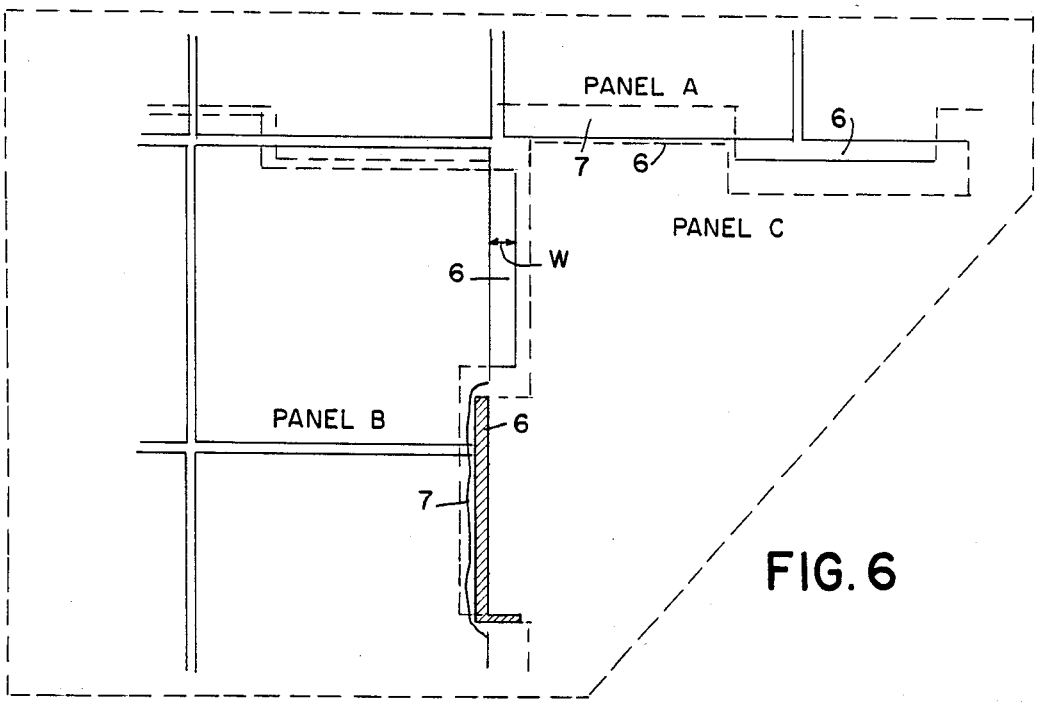
FIG. 6 is a schematic view illustrating the difficulty in installation of prefabricated tile panels which are outside of the present invention.

For example, the case where the difference (1) in the side lengths is W (i.e. $1 = Lc - Lv = W$) is shown in FIG. 6. In this case, when one tries to insert the convex portions of Panel C in the concave portions of Panel A, the convex portions of the neighboring side (adjacent to Panel B) of the Panel C overlap the convex portions of the Panel B to impede the insertion. Also, some deviations and/or warpages may often take place at a construction site, which will make the installation of panels further difficult. Thus, the above defined difference in side lengths between the concave and convex portions (i.e. $Lc - Lv \geqq 2 \times W$) is needed to conduct installation of the panels efficiently and effectively.

The prefabricated tile panel according to the present invention is generally of such size and weight as can be readily handled by a single working man, and normally has a weight of about 2 to about 8 kgs. The panel may be of a rectangular or square shape. For example, a rectangular panel having $3 \times 9$ pieces of 100 mm square tiles bonded to the substrate board has a dimension of about $300 \times 900$ mm and a weight of about 4 kgs and a thickness of about 9 mm.

A panel having $4 \times 12$ pieces of 75 mm square tiles has a dimension of about $312 \times 936$ mm. The tile may be ceramic tile, plastic tile and the like which are commercially available, and the ceramic or porcelain tile is preferred from the viewpoint of resistance to fire, moisture, chemicals and the like. The substrate board is not especially restricted as far as it has rigidity and mechanical strength sufficient to be practicable in actual uses, and is exemplified by an asbestos board having a thickness of about 2 to about 5 mm. Mineral or inorganic material boards are preferred from the viewpoint of resistance to fire, moisture, chemicals and the like.

Incidentally, the side lengths of the convex portions or the concave portions can be substantially of the same length, but distribution of these lengths may be controlled at the corners of the substrate board as necessary. When it is difficult to give the identical side length to the convex or concave portions, for example, in the manufacture of a mold or die for production of a substrate board, the side length of the convex portion can be made shorter and that of the concave portion can be made longer at the corners of the substrate board. For example, in FIG. 1 the side lengths of the convex portions (*6a*) and the concave portions (*7a*) at the four corners can be set at 59 mm and 87 mm, respectively, whereas the side lengths of the convex portions 6 and the concave portions 7 at the intermediate sides of the substrate board are set at 65 mm and 85 mm, respectively.

The prefabricated tile panel of the present invention can be installed at a construction site on the substructures such as wall, studs or frames, and the like by those unskilled in the art, by securing the tile panel onto the substructure with an adhesive and/or nails, inserting the convex portions of the next tile panel in the concave portions of the secured tile panel, setting the tile panels at a predetermined interval of tile joint and securing the tile panel in the same fashion, and so on, and then filling a joint compound into the joints 10 of tiles. The tile panels can be readily secured onto the substructure by applying an adhesive (e.g., an epoxy resin type) partially to the surface of the substructure or the back surface of the tile panel. When the substructure accepts nails without trouble, it is preferred to nail the tile panels to the substructure through the nailing holes 9 at the rectangular convex portions of the tile panel. Incidentally, conventional water-proof boards or sheets and other conventional foundation works can be utilized as necessary for installation of the present tile panels. Moreover, along the edges of the substructure on which the tile panels are to be installed, there are used special tile panels having no convex and concave portions on their corresponding side or sides or similar tile panels wherein the corresponding convex portions were cut off.

The prefabricated tile panel can be fabricated according to the foregoing method for producing the tile panel. The method is further explained in the following with reference to FIG. 2.

The substrate board 3 for the tile panel is generally more or less of a moisture-absorbing property, and thus it is preferred to apply a thin layer 5 of a waterproofing agent (e.g., comprising synthetic rubber dissolved in toluene and a filler) to the back surface of the substrate board 3 before or after the production of the tile panel, which will prevent the tile panel from absorbing moisture and warping of the panel. Application of an adhesive 4 for tiles 2 onto the top surface of the substrate board 3 to a uniform thickness can be satisfactorily conducted by applying the adhesive 4 in the form of side-long stripes with a comb-edged tool or trowel, wherein the width and interval of the stripes will be generally in the range of about 2 mm to about 5 mm and the thickness of the adhesive applied will be generally about 0.5 to about 2 mm. The adhesion between the tiles 2 and the substrate board 3 can be facilitated by pressing the substrate board 3 with a hand roller and preferably with a twin roller. The adhesive is applied to the surface of a substrate board except that of the convex and concave portions thereof. The adhesive to be used is of a rapidly setting type and can be an adhesive of epoxy resin, acrylic resin or synthetic rubber base.

The resulting prefabricated tile panel normally has a unit weight of 10 to 20 kgs/sq.meter, an adhesion strength between tiles and substrate board of at least about 5 kgf/sq. cm and an impact strength of at least about 6 kgf.cm/sq.cm.

Figure 4:
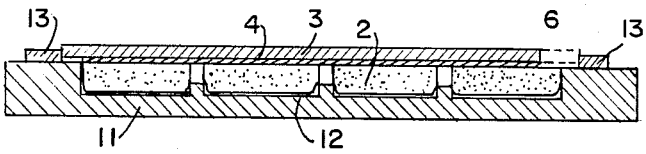
FIG. 4 is a schematic section view showing a frame for producing the present tile panel, which has matrixes for tiles and guide members for the substrate board.

The frame for producing the present tile panel is schematically illustrated in FIG. 4, wherein the frame 11 is provided with matrixes 12 for tiles 2 arranged regularly at a tile-joint interval in a rectangular or square form and guide members 13 such as crosspieces around the upper sides of the frame for accepting a substrate board 3 in a predetermined position, each of the matrixes preferably having an air vent or a hole for taking out the resulting tile panel readily at the bottom of the matrix.

Figure 2:
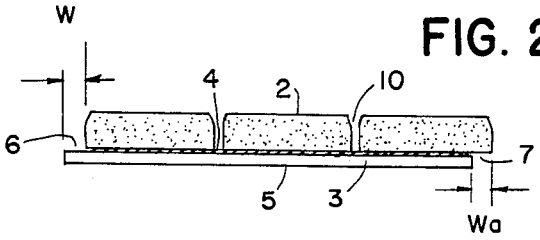
FIG. 2 is a sectional view of the prefabricated tile panel, taken along the line A—A of FIG. 1.
Figure 3:
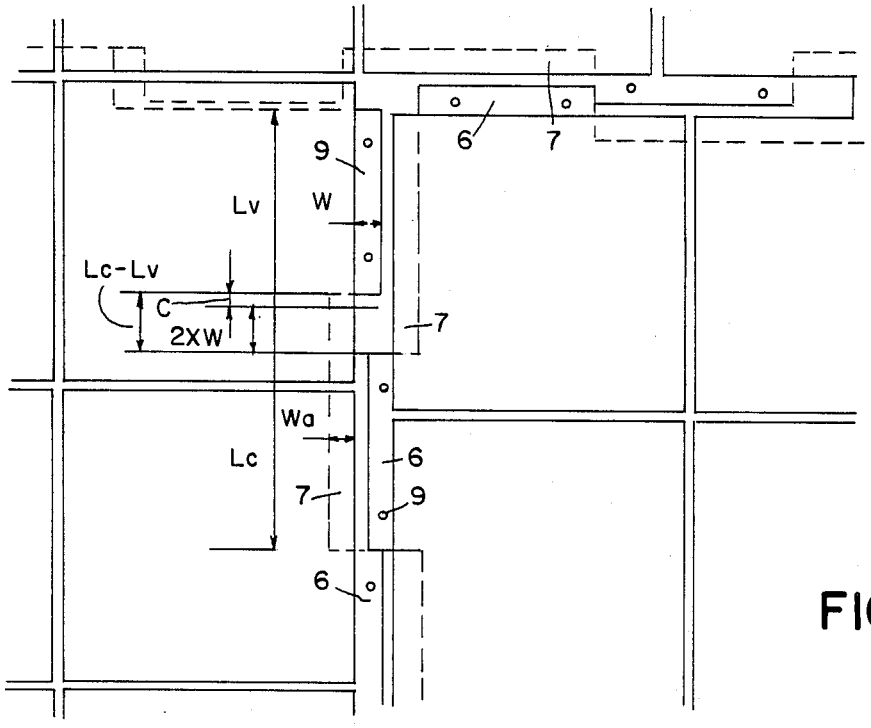
FIG. 3 is a schematic view showing installation of the prefabricated tile panels of the present invention.

Incidentally, in FIG. 2, the width Wa of the concave portion 7 has a width of at least W which is the width of the convex portion 6. The width Wa is normally the same as W or larger by several millimeters.

Description on the difference between the present tile panel and the conventional panel as illustrated by FIG. 5 is supplemented in the following. The present prefabricated tile panels of the same type can be assembled without trouble in the combination of lengthwise and sidewise arrangements, because they have no directional property as described above. On the other hand, the conventional panel as illustrated by FIG. 5 has a directional property as described above and can hardly be used in such combination of lengthwise and sidewise arrangements. In such a case, there will be needed an additional tile panel having the convex and concave structures which correspond to the configurations of the tile panels assembled and installed previously.

What is claimed is:

1. A prefabricated tile panel consisting essentially of a flat substrate board having substantially rectangular convex portions and substantially rectangular concave portions by turns around the sides of the substrate board, and a multiplicity of tiles arranged in a right-angled tetragon fashion and bonded onto the substrate board; said bonded tiles constituting a fundamental right-angled tetragon form, said rectangular convex portion being protruded by a given width of W from the fundamental tetragon form and having a side length of Lv; Lv being larger than W; said rectangular concave portion being set back by a width of at least W from the fundamental tetragon form and having a side length of Lc; the relationship between the W, Lv and Lc being defined by the following expression, $$Lc = Lv + 2 \times W;$$

said rectangular concave and convex portions being arranged regularly by turns on a basis of the shape of the fundamental tetragon form around the side of the substrate board in such a fashion that each side of the substrate board starts with one of the concave and convex portions followed by other portions by turns and ends with the other portion; the shape of a corner of the tile panel being substantially point-symmetrical with that of a diagonally opposite corner about the center of the diagonal; and the positions of the convex and concave portions present at one side of the tile panel substantially falling line-symmetrically under those of the other portions present at the opposite side thereof whereby said panel may be substantially symmetrically rotated within the plane of said flat substrate board 180° about the center of said panel.

2. The tile panel according to claim 1, in which the relationship between W, Lv and Lc is defined by the following expression, $$Lc = Lv + 2 \times W + C$$

wherein, W is in the range of about 5 to about 15 mm, and C is a length in the range of 0 to about 10 mm.

3. The tile panel according to claim 1, in which the tile is a ceramic or porcelain tile and the substrate board is a mineral or inorganic material board.

4. The tile panel according to claim 1, in which each of the convex portions of the substrate board has at least one small hole for nailing.

5. The tile panel according to claim 1, in which the side lengths of the convex portions at the corners of the substrate board are made shorter than and those of the concave portions at the corners are made longer than, the side lengths thereof, respectively, at the intermediate sides of the substrate board.

6. The tile panel according to claim 1, in which the tile panel is of a rectangular shape, wherein one pair of sides of said panel is longer than the other pair of sides of said panel.

7. The tile panel according to claim 3, in which the back surface of the substrate board is treated with a waterproofing agent.

8. The tile panel according to claim 1, in which the protruded width W is in the range of about 5 mm to about 15 mm.

* * * * *